US005103562A

United States Patent [19]

Braatz

[11] Patent Number: 5,103,562

[45] Date of Patent: Apr. 14, 1992

[54] PACKAGE OPENING TOOL

[76] Inventor: Harold Braatz, Rte. 1, 224 Pipeline La., Eden, Wis. 53019

[21] Appl. No.: 604,161

[22] Filed: Oct. 29, 1990

[51] Int. Cl.[5] ..... B67B 7/00

[52] U.S. Cl. ..... 30/294; 30/2; 30/DIG. 3

[58] Field of Search ..... 30/289, 294, DIG. 3, 30/2; 83/912

[56] References Cited

U.S. PATENT DOCUMENTS 1,216,889 2/1917 Todd ..... 30/DIG. 3
4,711,031 12/1987 Annello ..... 30/DIG. 3

OTHER PUBLICATIONS

Exhibit 1.

*Primary Examiner*—Douglas D. Watts
*Attorney, Agent, or Firm*—Donald Cayen

[57] ABSTRACT

A package opening tool is useful for opening packages made of cellophane and other flexible plastic materials. The package opening tool comprises first and second plates pivotally connected at their respective back ends. The two plates are biased, as by a living hinge or a spring, to an open configuration whereat there is a V-shaped gap between the plates. The first plate has a cutter that faces the second plate. A package is inserted into the gap, and the tool is operated to a closed configuration by squeezing the front ends of the two plates together to cause the cutter to penetrate the package. A recess in the second plate receives the entire cutter when the tool is in the closed configuration. Then pulling the package from between the closed tool slices the package for easy further opening. The first plate preferably has a wall around the cutter to restrict access to the cutter. In some embodiments, positive stops limit the relative locations of the two plates in the open and closed configurations.

33 Claims, 3 Drawing Sheets

PACKAGE OPENING TOOL

BACKGROUND OF THE INVENTION

1. Field of the Invention

This invention pertains to cutting devices, and more particularly to apparatus for slitting thin sheet materials.

2. Description of the Prior Art

The ubiquitous plastic packages that hold snack foods and other products possess many advantages. The packages are inexpensive, sanitary, and easily disposable. The packaging material is very strong, and it is usually transparent so as to permit consumers to see the package contents.

On the other hand, the strength of the plastic packaging material presents a problem that is as widespread as the packages themselves—how to open the packages. Manually tearing open a package is very difficult. In some packages, it is possible to spread the package walls and pull them apart at a seam, but that method has limited usefulness. Cutting instruments such as knives and scissors can easily cut a package, but those instruments are rarely at hand when needed. As a consequence, people often resort to using their teeth or any convenient sharp object to open a package, often with harmful results to the fragile contents.

A prior tool for opening plastic packages is marketed commercially under the trademark CHEF CRAFT. That tool includes a short blade point embedded in one end of an elongated plate. The other end of the plate is hingedly connected to a second generally parallel plate. By placing a plastic package between the two plates and squeezing them together, the bag is punctured. Then pulling the bag causes the blade to slice the bag. Despite its apparent usefulness, the prior tool has a couple of disadvantages. The blade is installed in a direction perpendicular to the lenth of the plates, which makes the tool rather awkward to use. The blade tip contacts the opposite plate during operation, which causes the blade to rip and tear the bag rather than to neatly slice it. Further, the blade is quite exposed and accessible to the user's fingers, thereby rendering it dangerous to use.

Thus, a need exists for a way to easily open plastic packages.

SUMMARY OF THE INVENTION

In accordance with the present invention, an inexpensive and convenient package opening tool is provided that quickly and reliably opens plastic food packages and the like. This is accomplished by apparatus that includes a cutting element concealed in the gap between a pair of closely spaced and pivotally connected plates.

In the preferred embodiment, the package opening tool plates are generally rectangular. The plates are pivotally connected at their respective first ends, as by a living hinge. The plates normally define a small acute angle such that a rather sharp V-shaped gap exists between them. The living hinge is designed to bias the plates to increase the gap between them. The package opening tool is said to be an open configuration when a gap exists between the two plates.

To limit the spread or angle between the two plates, the package opening tool may comprise a catch acting between them. The catch acts against the biasing force of the living hinge to prevent the plates from spreading apart greater than a predetermined distance.

The package opening tool is closeable from the open configuration to a closed configuration by manually squeezing the plates together against the biasing force of the living hinge. The closed configuration may be defined by a positive stop acting between the plates. The plates are generally parallel and in facing contact with each other and the gap disappears when the tool is in the closed configuration.

The first plate preferably has an upstanding wall that extends across its second end and along its side edges. A pair of guide surfaces may extend from the wall generally perpendicular to the plane of the first plate at a location approximately midway between the plate ends.

The package opening tool further comprises a sharp edge cutter embedded in o otherwise joined to the first plate near its second end. The plane of the cutter is parallel to the longitudinal dimensions of the plates. The cutter has a tip that lies between the first plate and the plane that contains the free ends of the upstanding wall on the first plate. Accordingly, when the package opening tool is in the open configuration, the cutter is inaccessible to a person's fingers. A recess is formed in the second plate opposite the cutter. The recess receives the cutter tip when the package opening tool is squeezed to the closed configuration.

The package opening tool may be molded as a single piece from a tough thermosetting plastic material. The cutter may be integral with the first plate, that is, the cutter may be molded of the plastic material. Alternately, the cutter may be a sharp steel component such as a blade or pin inserted and bonded into the first plate.

The outside surface of either plate may be provided with a magnet for storing the package opening tool on a ferrous surface. Further, either plate may have a clip for retaining the package opening tool in a shirt pocket or the like. If desired, the clip may be in the form of a flexible U-shaped loop that is attached to the opposite edges of one of the plates near the living hinge and extends around the plate periphery.

In use, the two plates are released such that the living hinge biases the package opening tool to its open configuration, which is controlled by the catch. A margin of the food package or the like to be opened is inserted into the gap between the two plates. The guide surfaces limit the distance the package margin is inserted into the gap. The user then squeezes the plates together, which forces the cutter to penetrate the package as the cutter tip enters the recess in the second plate and does not contact the second plate. The positive stop limits the approach of the two plates toward each other so as not to bind the package material between them. Then the package is pulled from between the plates, and the cutter slits the package material as the package is pulled. The package is then easily torn manually at the slit to gain access to the contents.

In a modified embodiment, the package opening tool does not have a catch, positive stop, or wall. The living hinge between the plates is designed to retain them at their proper angular relation in the open configuration. The cutter tip is quite close to the second plate, so that danger from the cutter to a person's fingers is minimal. The recess in the second plate may extend entirely through that plate. Squeezing the plates together forces the cutter to penetrate a package placed between them, and withdrawing the package from between the plates causes the cutter to slit the package.

In another embodiment of the invention, the first plate is fabricated with a short wall that extends along the side edges of the second plate. The second plate is formed with a pair of longitudinal extending ridges that straddle the cutter when the tool is in the closed configuration. The ridges serve as stops that define the closed configuration, and no recess is necessary in the second plate. The second plate is guided by and nests within the wall of the first plate when the tool is in the closed configuration.

The plates need not be shaped as solid rectangles. Rather, the plates may have notches in their respective first ends. The notches may extend almost as far as the cutter and the recess in the first and second plates, respectively.

The two plates need not be made as one piece connected by a living hinge. Rather, the two plates may be separate pieces connected by a pivotal joint. In that design, the tool is biased to and retained in the open configuration by a spring, such as a generally U-shaped leaf spring. The opposite ends of the spring are retained within the respective plates.

Other advantages, benefits, and features of the invention will become apparent to those skilled in the art upon reading the detailed description of the invention.

DETAILED DESCRIPTION OF THE INVENTION

Figure 1:
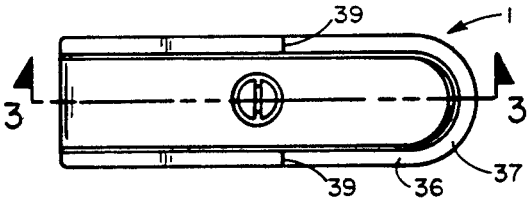
FIG. 1 is a top view of the package opening tool of the present invention.
Figure 3:
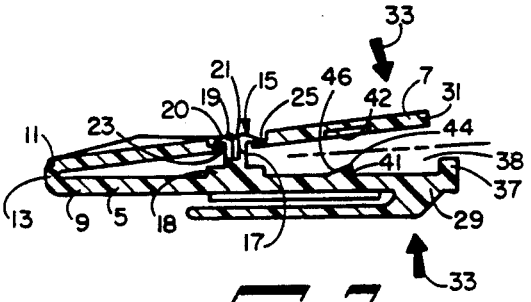
FIG. 3 is a cross sectional view taken along lines 3—3 of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1-5, a package opening tool 1 is illustrated that includes the present invention. The package opening tool is particularly useful for opening flexible plastic food packages schematically represented at reference numeral 3. However, it will be understood that the invention is not limited to food related applications.

The package opening tool 1 is comprised of a bottom plate 5 and a top plate 7. The back end 9 of the bottom plate 5 is flexibly connected to the back end 11 of the top plate 7 by a living hinge 13. The package opening tool 1 is shown in an open configuration in FIGS. 2 and 3. In the open configuration, a rather small angle of approximately 5 degrees to 7 degrees exists between the plates, so that a V-shaped gap 38 also exists between the two plates. The living hinge 13 biases the two plates away from each other so as to tend to increase the angle between them and thus increase the gap 38.

To limit the gap 38 between the bottom and top plates 5 and 7, respectively, when it is in the open configuration, the package opening tool 1 further comprises a catch system 15. In the construction illustrated in FIGS. 1-5, the catch system 15 includes a short post 17 upstanding from a boss 18 formed integrally with the bottom plate. The free end of the post 17 terminates in a mushroom shaped cap 19. The cap 19 and at least part of the post 17 are fabricated with a slit 21. The top plate 7 is formed with a hole 23 therethrough that may have a counterbore 25. The hole 23 is sized to accept the post 17 and cap 19. When the top plate is pushed toward the bottom plate 5, the top plate contacts the cap sloped surface 20 and forces the post and cap together through the width of the slit 21. After the cap has passed through the hole 23, the counterbore surface 25 contacts the cap undercuts 27 to limit the open configuration of the package opening tool 1 against the biasing force of the living hinge 13.

Figure 4:
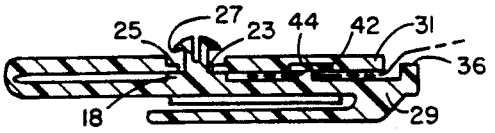
FIG. 4 is a view similar to FIG. 3, but showing the package opening tool in the closed configuration.
Figure 5:
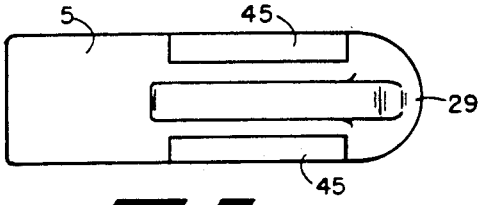
FIG. 5 is a bottom view of the package opening tool of FIG. 2.
Figure 6:
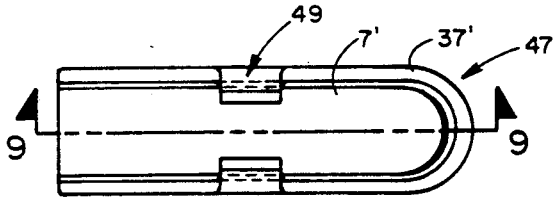
FIG. 6 is a top view of a modified embodiment of the package opening tool.

The closed configuration of the package opening tool 1 is best shown in FIG. 4. The closed configuration is achieved by manually squeezing the front ends 29 and 31 of the bottom and top plates 5 and 7, respectively, toward each other in the direction of arrows 33. To limit the approach of the plates, a positive stop is employed. Preferably, the boss 18 acts as the positive stop. The height of the boss 18 is chosen such that the bottom and top plates are generally parallel when the package opening tool is in the closed configuration.

Extending around the side edges and the front end 29 of the bottom plate 5 is a short upstanding wall 37. The wall 37 is located such that the top plate 7 nests inside the wall when the package opening tool 1 is in the closed configuration. As is best seen by comparing FIGS. 2 and 3, the V-shaped gap 38' between the top plate and the free end 36 of the wall 37 is substantially less than the gap 38 between the top and bottom plates. The wall 37 along the side edges of the bottom plate is formed with guide surfaces 39 approximately half way between the bottom plate back and front ends 9 and 29, respectively.

Figure 2:
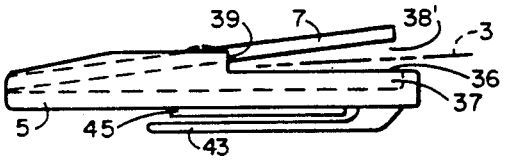
FIG. 2 is a front view of FIG. 1.

Between the bottom plate front end 29 and the boss 18 is located a cutter 41 with a sharp tip 44. In the particular construction illustrated in FIGS. 3 and 4, the cutter 41 is fabricated as a thin blade integral with the bottom plate 5. The cutter is oriented generally parallel to the tool longitudinal direction. The tip 44 of the cutter 41 protrudes from the bottom plate 5 for a distance less than the height of the wall 37. Accordingly, as best shown in FIG. 2, the cutter 41 is inaccessible to a person's fingers. The cutter tip 44 enters a recess or depression 42 in the top plate 7 when the package opening tool 1 is in the closed configuration, FIG. 4.

To store the package opening tool 1 in a convenient location, it may be formed with a clip 43. The clip 43 is shown joined to the bottom plate 5, but it will be appreciated that the clip may just as well be joined to the top plate 7. To further increase the versatility of the package opening tool, one or more magnets 45 can be bonded to the bottom plate (or to the top plate) for storing the package opening tool on any convenient ferrous surface.

To use the package opening tool 1, a person holds it in one of his hands, with the tool being in the open configuration. He inserts the margin of a flexible package 3 into the gap 38' between the bottom plate wall 37 and the top plate 7. The guide surfaces 39 serve as stops that prevent the package from wedging between the bottom plate wall and the top plate. The user then squeezes the two plates together in the direction of arrows 33. The wall 37 guides the top plate as the package opening tool is pivoted between the open and closed configurations. As a consequence, the gap 38' disappears and the cutter 41 penetrates the package. Then, by pulling the package from between the two plates, the cutter 41 cleanly slits the package for a short distance. The person can then easily tear the package at the slit and gain access to the contents. Upon releasing the plates, the natural resiliency of the tool material at the living hinge 13 returns the package opening tool to the open configuration, ready to accept and open another package.

The various portions of the package opening tool 1 may be made of any suitable materials and joined in any suitable manner. However, I prefer that the package opening tool be molded as a single piece from a tough thermosetting plastic material. The bottom plate 5 is molded to include the cutter 41. The living hinge 13 is designed to have good fatigue strength and thereby provide a long service life to the tool.

Figure 9:
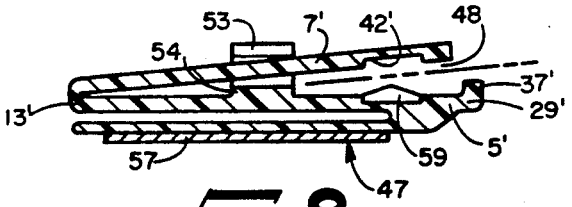
FIG. 9 is a cross sectional view taken along lines 9—9 of FIG. 6.
Figure 7:
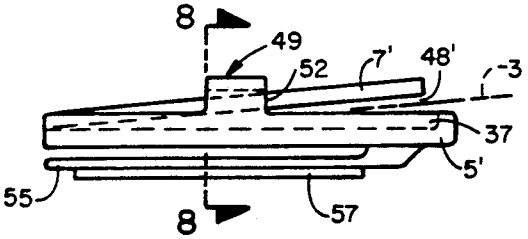
FIG. 7 is a front view of FIG. 6.
Figure 8:
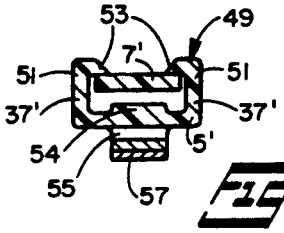
FIG. 8 is a cross sectional view taken along lines 8—8 of FIG. 7.

FIGS. 6–9 depict a modified package opening tool 47. The package opening tool 47 has a bottom plate 5', a top plate 7', and a living hinge 13'. A wall 37' extends along the two side edges and the front end 29' of the bottom plate 5'. The gap 48' of the package opening tool 47 between the bottom plate wall 37' and the top plate 7' is limited in its open configuration against the biasing force of the living hinge 13' by a pair of snaps 49. Each snap 49 is comprised of a short flexible leg 51 upstanding from the bottom plate wall 37'. The forward edges 52 of the legs 51 serve as guide surfaces analogous to the guide surfaces 39 of the package opening tool 1 described previously in connection with FIGS. 1–5. The free ends of the legs 51 terminate in allochiral hooks 53. The hooks 53 overlie the top plate 7' and restrain it from opening further relative to the bottom plate 5' under the biasing force of the living hinge 13'. A post 54 integral with the bottom plate 5' limits the approach of the bottom and top plates toward each other when the package opening tool 47 is in the closed configuration (not shown in the drawings). In FIGS. 7–9, the package opening tool 47 is shown with a clip 55 joined to the bottom plate 5'. A magnet 57 may be bonded to the outside surface of the clip 55.

In FIG. 9, the cutter 59 is shown as a component that is not an integral part of the bottom plate 5'. Rather, the package opening tool 47 of FIG. 9 utilizes a cutter 59 that is made as a thin steel blade and inserted and bonded into an appropriate groove in the bottom plate 5'. The top plate 7' is formed with a recess 42' for receiving the cutter 59 in a manner identical to that described in conjunction with the package opening tool 1 of FIGS. 1–5.

It will be appreciated, of course, that the particular combination of components shown in the package opening tools 1 and 47 can be interchanged without departing from the spirit of the present invention. For example, the dual magnets 45 of the package opening tool 1 may be interchanged with the single magnet 51 of the package opening tool 47. Similarly, a separate cutter 59 as shown inserted in the bottom plate 5' of the package opening tool 47 can be used with the package opening tool 1 instead of the integral cutter 41 shown in FIGS. 3 and 4.

Figure 10:
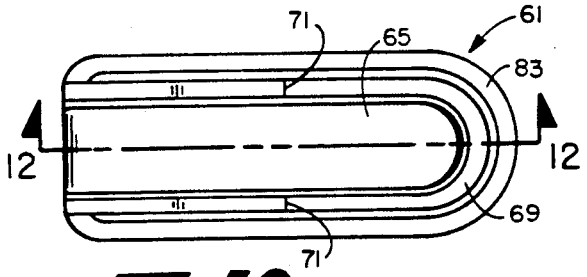
FIG. 10 is a top view of a further modified embodiment of the present invention.
Figure 12:
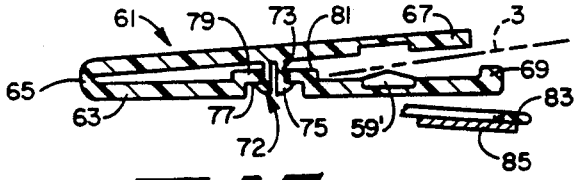
FIG. 12 is a cross sectional view taken along lines 12—12 of FIG. 10.
Figure 11:
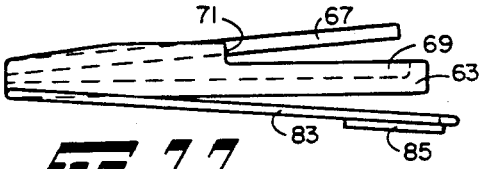
FIG. 11 is a front view of FIG. 10.

FIGS. 10–12 illustrate another embodiment of the invention. In FIGS. 10–12, a package opening tool 61 has a bottom plate 63 flexibly connected by a living hinge 65 to a top plate 67. The bottom plate 63 has a peripheral wall 69 that includes guide surfaces 71. The package opening tool 61 is shown with a separate cutter 59' inserted into the bottom plate 63.

To limit the open configuration of the package opening tool 61, a catch 72 including a split post 73 is joined to the inside surface of the top plate 67. The split post 73 terminates in a pair of hooked caps 75. The caps 75 and post 73 are passable through a hole in the bottom plate 63 to enable the caps to lock against a counterbore 77 in the bottom plate. The counterbore 77 is formed in a boss 79 integral with the bottom plate 63. End surface 81 of the boss 79 acts as a stop that defines the relative locations of the bottom and top plates 63 and 67, respectively, when the package opening tool 61 is in the closed configuration (not shown).

To store the package opening tool 63, a flexible generally U-shaped loop 83 is joined to either the bottom plate 63 or to the top plate 67 near the living hinge 65. The loop 83 is designed with sufficient flexibility to enable it to cooperate with the plate to which it is joined to clip over a thin planar object such as a shirt pocket or the like. If desired, a magnet 85 can be bonded to the loop 83. It will be appreciated, of course, that the loop 83 may also be used with the package opening tools 1 and 47 described above.

Figure 14:
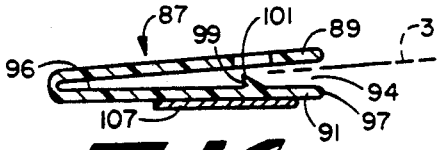
FIG. 14 is a cross sectional view taken along lines 14—14 of FIG. 13.
Figure 13:
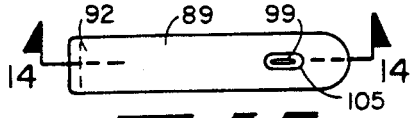
FIG. 13 is a top view of another embodiment of the invention.
Figure 15:
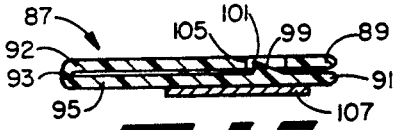
FIG. 15 is a view similar to FIG. 14, but showing the package opening tool in the closed configuration.
Figure 16:
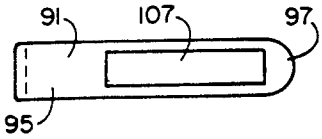
FIG. 16 is a bottom view of the package opening tool of FIGS. 13-15.

Now looking at FIGS. 13–16, a package opening tool 87 has generally identically sized and shaped top and bottom plates 89 and 91, respectively. The back ends 92 and 95 of the plates 89 and 91, respectively, are joined by a living hinge 93. The living hinge 93 is designed to locate the two plates in a relaxed condition whereat the package opening tool 87 is in the open configuration of FIG. 14. The two plates preferably make an angle of approximately 6 degrees to 9 degrees with each other when the package opening tool is in the open configuration to thereby create a gap 94. To the inside surface 96 of the bottom plate 91 near its front end 97 is attached a cutter 99. Like the cutters 41, 59, and 59' described previously in connection with the package opening tools 1, 47, and 61, respectively, the cutter 99 may be molded integrally with the bottom plate 91 as is shown in FIGS. 14 and 15, or the cutter 99 may be a separate piece inserted and bonded into the bottom plate. In either situation, it is preferred that the cutter point backwardly toward the living hinge 93. When the package opening tool 87 is in the open configuration of FIG. 14, the cutter tip 101 lies within the gap 94 between the two plates. Access to the cutter 99 with the package opening tool in the open configuration of FIG. 14 is prevented by the small size of the gap 94.

To permit closing the package opening tool 87 to the closed configuration of FIG. 15, the top plate 89 is manufactured with a recess in the form of a slot 105 or similar opening that extends completely through the top plate. The slot 105 is designed to prevent access of a person's finger to the cutter 99 through the slot. Further, the cutter lies entirely within the slot when the package opening tool 87 is in the closed configuration, thereby preventing injury from the tip 101. A magnet 107 may be bonded to either plate, if desired, for holding the package opening tool 87 on a ferrous surface.

In use, a plastic bag or similar package 3 is inserted between the plate 89 and the cutter 99 of the open package opening tool 87. Upon squeezing the front ends of the plates 89 and 91 together, the cutter point 101 penetrates the package. Then pulling the package out from between the two plates while holding them closed causes the cutter to slit the package. Upon complete withdrawal of the package and release of the plates, the natural resiliency of the living hinge 93 restores the package opening tool to its open configuration of FIG. 14. At all times, the cutter 99 is inaccessible to the user's fingers.

Figure 17:
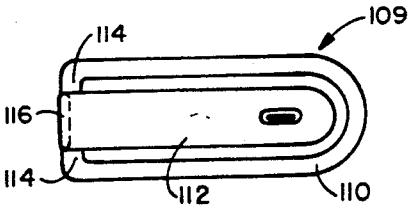
FIG. 17 is a top view similar to FIG. 13, but showing an alternate means for attaching the package opening tool to a selected object.

FIG. 17 depicts a package opening tool 109 that is generally similar to the package opening tool 87 of FIGS. 13–16. However, the package opening tool 109 includes a clip in the form of a U-shaped loop 110 that surrounds three sides of the top plate 112 or of the bottom plate. In FIG. 17, only top plate 112 is shown. The free ends 114 of the loop 110 join to the top or bottom plate in the region of the living hinge 116 between the two plates. The loop 110 is resiliently deformable relative to the plates to enable the package opening tool 109 to be clipped to a shirt pocket or the like in a manner similar to that described in connection with the package opening tool 61 of FIGS. 10–12.

Figure 18:
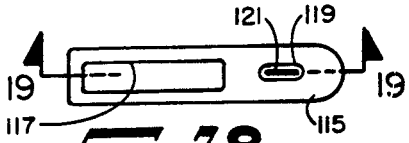
FIG. 18 is a top view of an additional embodiment of the present invention.
Figure 19:
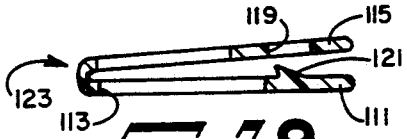
FIG. 19 is a front view of FIG. 18.
Figure 20:
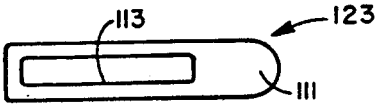
FIG. 20 is a bottom view of FIG. 19.

The modified package opening tool 123 of FIGS. 18–20 is also generally similar to the package opening tool 87 of FIGS. 13–16. To reduce the amount of material required, the top plate 115 of the package opening tool 123 has a rather large opening 117. Similarly, the bottom plate 111 has an opening 113. The top plate 115 further has a slot 119 designed to safely receive the cutter 121 when the package opening tool 123 is in the closed configuration (not shown). In other respects, the package opening tool 123 is similar in structure and function to the package opening tool 87 described previously in connection with FIGS. 13–16.

Figure 21:
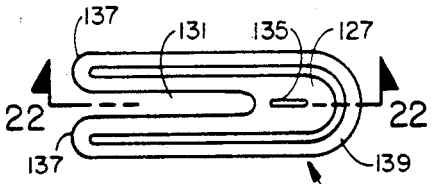
FIG. 21 is a top view of a different embodiment of the present invention.
Figure 29:
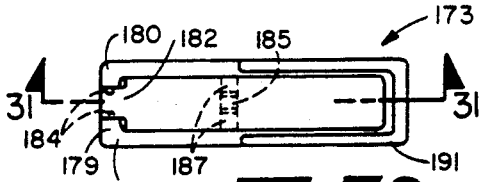
FIG. 29 is a top view of a package opening tool that utilizes a leaf spring.
Figure 22:
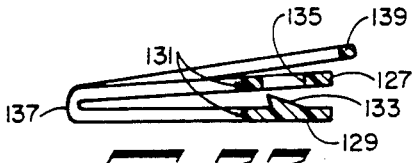
FIG. 22 is a cross sectional view taken along lines 22—22 of FIG. 21.

In FIGS. 21 and 22, a package opening tool 125 has a top plate 127 and a bottom plate 129 of substantially similar outlines. The top and bottom plates are joined at their respective back ends by a living hinge 137. Both plates 127 and 129 have deep notches 131 extending inwardly from their respective back ends. The bottom plate 129 is provided with a cutter 133 similar to the cutter 99 of the package opening tool 87 of FIGS. 13–16. The top plate 127 is fabricated with a slot 135 for receiving the cutter 133 when the package opening tool 125 is in the closed configuration.

Joined to the living hinge 137 between the top plate 127 and the bottom plate 129 are the free ends of a U-shaped loop 139. Like the loop 83 of the package opening tool 61 (FIGS. 10–12) and the loop 110 of the package opening tool 109 (FIG. 17), the loop 139 enables the package opening tool 125 to be clipped to a shirt pocket or similar thin planar member.

Figure 23:
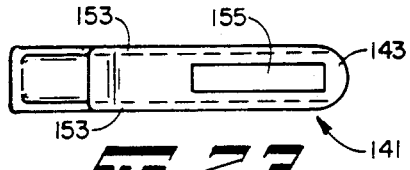
FIG. 23 is a top view of another package opening tool according to the present invention.
Figure 24:
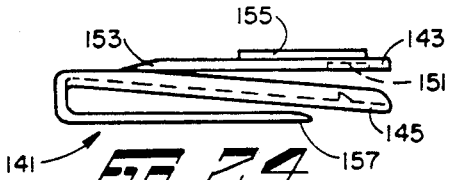
FIG. 24 is a front view of FIG. 23.
Figure 25:
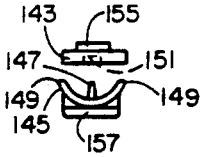
FIG. 25 is an end view of FIG. 24.
Figure 32:
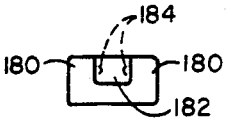
FIG. 32 is a view taken along lines 32—32 of FIG. 30.

FIGS. 23–25 show an alternate embodiment of the present invention in which a package opening tool 141 has a top plate 143 with a flat cross section and a bottom plate 145 with a curved cross section. A cutter 147 is embedded in the bottom plate 145. Preferably, the plane defined by the edges 149 of the bottom plate 145 lie closer to the top plate 143 than does the tip of the cutter 147. The top plate 143 has a recess 151 that receives a portion of the cutter 147 when the package opening tool 141 is in the closed configuration, not shown. The top plate 143 may extend across and be joined to the bottom plate edges 149 at a hinge portion 153. A magnet 155 may be bonded to the top plate 143. Further, the package opening tool 141 may include an integral clip 157 that doubles back under the bottom plate 145.

Figure 26:
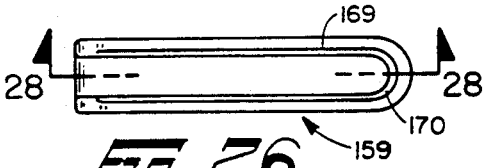
FIG. 26 is a top view of a preferred embodiment of the present invention.
Figure 27:
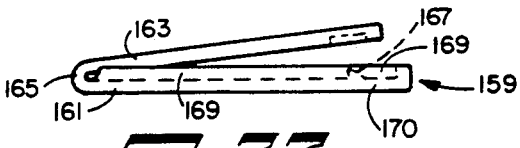
FIG. 27 is a front view of FIG. 26.
Figure 28:
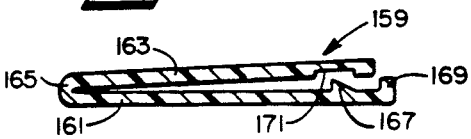
FIG. 28 is a cross sectional view taken along lines 28—28 of FIG. 26.

In FIGS. 26–28, a package opening tool 159 has a bottom plate 161, a top plate 163, and a living hinge 165 connecting the top and bottom plates. A cutter 167 is embedded in the bottom plate 161. A wall 169 is joined to and extends perpendicularly from the bottom plate 161 at the front end 170 and along the side edges thereof. The height of the wall 169 is preferably approximately equal to the thickness of the top plate 163. Accordingly, as shown in FIG. 28, in the closed configuration the bottom plate 161 and the top plate 163 are in facing contact, although for clarity a slight space is shown between the top and bottom plates in FIG. 28. The wall 169 guides the top plate as the package opening tool 159 approaches the closed configuration of FIG. 28. To enable facing contact between the plates, the top plate is formed with a recess 171 for receiving the cutter 167. The thin nature of the package opening tool 159 when in the closed configuration makes it especially attractive for storing in a billfold between uses.

FIGS. 29–32 illustrate a package opening tool 173 having a bottom plate 175 and a top plate 177 that are separate pieces. The two plates 175 and 177 are pivotally connected at a mechanical hinge 179. The mechanical hinge 179 may be in the form of a pair of extensions 180 of the bottom plate 175 that straddle a central lug 182 on the top plate 177. Snap detents 184 may be used to pivotally retain the extensions 180 and lug 182 to each other and thus keep the top and bottom plates together.

Figure 30:
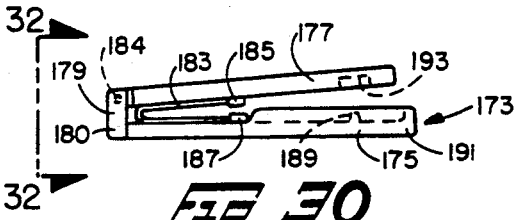
FIG. 30 is a front view of FIG. 29.
Figure 31:
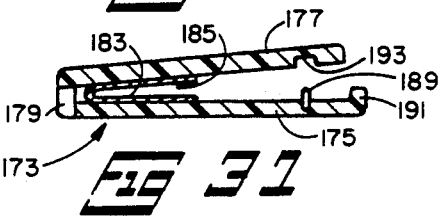
FIG. 31 is a cross sectional view taken along lines 31—31 of FIG. 29.

The bottom and top plates 175 and 177, respectively, are biased to the open configuration of FIGS. 30 and 31 by a generally U-shaped leaf spring 183. The ends of the leaf spring 183 are provided with short tabs that are retained in respective slotted guides 187 and 185 that form integral parts of the bottom and top plates 175 and 177, respectively. The package opening tool 173 is shown with a cutter in the form of a sharp pin 189 embedded in the bottom plate 175. If desired, the pin 189 may slant backwardly toward the hinge 179. The tip of the pin 189 does not protrude above the free end of a wall 191 that extends around the front end and a portion of the side edges of the bottom plate 175. A recess 193 in the top plate 177 receives the pin 189 when the package opening tool 173 is in the closed configuration, not shown in the drawings. In the closed configuration, the package opening tool 173 has the same general appearance as the package opening tool 159 described previously in conjunction with FIGS. 26–28.

Figure 33:
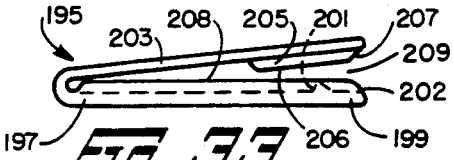
FIG. 33 is a side view of a variation of the package opening tool of the present invention shown in an open configuration.
Figure 34:
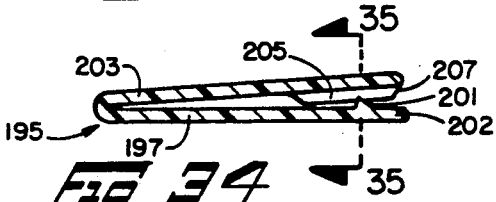
FIG. 34 is a longitudinal cross sectional view of the package opening tool of FIG. 33, but showing the tool in a closed configuration.
Figure 35:
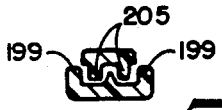
FIG. 35 is a cross sectional view taken along lines 35—35 of FIG. 34.

In FIGS. 33–35, a package opening tool 195 is shown that has a bottom plate 197 and a top plate 203 of about equal lengths. A cutter 201 is formed in the bottom plate 197. A wall 199 upstands from the side edges of the bottom plate, but the wall need not extend around the front end 202 of the bottom plate. The front end 202 of the bottom plate blends into a gradual lead-in 204 at the front end of the walls 199 along the bottom plate side edges.

The top plate 203 is fabricated with a pair of spaced longitudinally extending ridges 205. The ridges 205 straddle the cutter 201 when the package opening tool 195 is in the closed configuration of FIGS. 34 and 35. The two walls 199 guide the top plate as it approaches the bottom plate 197 to the closed configuration. The free ends 206 of the ridges serve as positive stops that limit the approach of the top and bottom plates toward each other and thus define the closed configuration. The free ends 206 of the ridges also cooperate with the free ends 208 of the walls 199 to define the gap 209. The ridges are high enough such that no recess for the cutter 201 is required in the top plate 203. It is preferred that the ridges have tapered lead-ins 207 that are aligned with the bottom plate wall lead-ins 204.

Thus, it is apparent that there has been provided, in accordance with the invention, a package opening tool that fully satisfies the aims and advantages set forth above. While the invention has been described in conjunction with specific embodiments thereof, it is evident that many alternatives, modifications, and variations will be apparent to those skilled in the art in light of the foregoing description. For example, either an integral cutter 41, a separate blade 59, or a pin 189 may be employed with any of the package opening tools 1, 47, 61, 87, 109, 123, 125, 141, 159, 173, and 195. Further, any combination of clips, such as clip 157 of package opening tool 141, and magnets, such as magnet 155, may be employed with any of the package opening tools. Accordingly, it is intended to embrace all such alternatives, modifications, and variations as fall within the spirit and broad scope of the appended claims.

I claim:

1. A package opening tool comprising:

a. a bottom plate having a front end, opposed side edges, and a back end;

b. a cutter joined to and protruding from the bottom plate proximate the front end thereof and having a tip, wherein the cutter is formed as a thin blade that lies in a plane that extends between the front and back ends of the bottom plate;

c. a top plate having a front end and a back end pivotally joined to the bottom plate back end; and d. biasing means for maintaining the package opening tool in an open configuration whereat the top and bottom plates make an acute angle with respect to each other to define a generally V-shaped gap therebetween with the cutter being located within the gap, the top and bottom plates being pivotable relative to each other to a closed configuration whereat the top and bottom plates lie generally parallel to each other, so that the margin of a flexible package or the like can be inserted into the gap between the top and bottom plates when the package opening tool is in the open configuration and the plates can be pivoted to the closed configuration to penetrate the package with the cutter and thereby open the package.

2. A package opening tool comprising:

a. a bottom plate having a front end, opposed side edges, and a back end;

b. a cutter joined to and protruding from the bottom plate proximate the front end thereof and having a tip;

c. a top plate having a front end and a back end pivotally joined to the bottom plate back end, wherein the top plate defines a recess aligned with the cutter in the bottom plate, the recess having a depth sufficient to receive the entire cutter protruding from the bottom plate; and d. biasing means for maintaining the package opening tool in an open configuration whereat the top and bottom plates make an acute angle with respect to each other to define a generally V-shaped gap therebetween with the cutter being located within the gap, the top and bottom plates being pivotable relative to each other to a closed configuration whereat the top and bottom plates lie generally parallel to each other, so that the margin of a flexible package or the like can be inserted into the gap between the top and bottom plates when the package opening tool is in the open configuration and the plates can be pivoted to the closed configuration to penetrate the package with the cutter and thereby open the package and the cutter does not contact the top plate when the packaging opening tool is in the closed configuration.

3. The package opening tool of claim 1 further comprising catch means formed on a selected one of the top and bottom plates for controlling the relative locations of the top and bottom plates when the package opening tool is in the open configuration.

4. A package opening tool comprising:

a. a bottom plate having a front end, opposed side edges, and a back end;

b. a cutter joined to and protruding from the bottom plate proximate the front end thereof and having a tip, wherein a wall is formed on and upstands from the bottom plate around at least a portion of the side edges and front end thereof, the wall having a free end that extends to a greater distance from the bottom plate than the cutter tip;

c. a top plate having a front end and a back end pivotally joined to the bottom plate back end; and d. biasing means for maintaining the package opening tool in an open configuration whereat the top and bottom plates make an acute angle with respect to each other to define a generally V-shaped gap therebetween with the cutter being located within the gap, the top and bottom plates being pivotable relative to each other to a closed configuration whereat the top and bottom plates lie generally parallel to each other, so that the margin of a flexible package or the like can be inserted into the gap between the top and bottom plates when the package opening tool is in the open configuration and the plates can be pivoted to the closed configuration to penetrate the package with the cutter and thereby open the package and the wall limits accessibility to the cutter.

5. The package opening tool of claim 1 wherein a clip is joined to a selected one of the top and bottom plates to enable the package opening tool to be worn in a shirt pocket or the like.

6. The package opening tool of claim 4 wherein the wall is formed with a pair of generally coplanar guide surfaces upstanding from the wall free end approximately midway between the front and back ends of the bottom plate, the coplanar guide surfaces limiting the insertion of the flexible package or the like into the gap between the top and bottom plates.

7. The package opening tool of claim 4 wherein the bottom plate is formed with snap means for controlling the relative locations of the top and bottom plates when the package opening tool is in the open configuration.

8. The package opening tool of claim 7 wherein the snap means comprises guide surfaces generally perpendicular to the plane of the bottom plate for limiting the insertion of the flexible package or the like into the gap between the top and bottom plates.

9. The package opening tool of claim 2 wherein:

a. the bottom plate is formed with a wall upstanding therefrom around the front end and at least a portion of the side edges thereof; and b. the top plate nests within the bottom plate wall when the package opening tool is in the closed configuration.

10. The package opening tool of claim 1 further comprising a flexible generally U-shaped loop having ends joined to a selected one of the top or bottom plates proximate the back end thereof, the flexible loop cooperating with the selected plate to enable a person to clip the package opening tool on a selected thin planar object.

11. The package opening tool of claim 2 wherein:

a. the top plate has a first surface facing the bottom plate and an opposed second surface;

b. the recess in the top plate extends between the first and second surfaces; and c. the cutter in the bottom plates lies within the recess of the top plate when the package opening tool is in the closed configuration and the cutter tip lies between the top plate first and second surfaces.

12. The package opening tool of claim 11 wherein the top and bottom plates are in facing contact when the package opening tool is in the closed configuration.

13. The package opening tool of claim 1 wherein:

a. the bottom plate has a curved cross section that is concave facing the top plate;

b. the bottom plate side edges define a plane; and c. the plate defined by the bottom plate side edges lies between the cutter tip and the top plate.

14. The package opening tool of claim 1 wherein the biasing means comprises spring means captured within and acting between the top and bottom plates to bias the package opening tool to the open configuration.

15. The package opening tool of claim 1 further comprising stop means formed on a selected one of the top and bottom plates for controlling the relative locations of the top and bottom plates when the package opening tool is in the closed configuration, and wherein the stop means comprises a pair of spaced apart ridges fabricated on the top plate, the ridges straddling the cutter when the tool is in the closed configuration.

16. A package opening tool comprising:

a. a bottom plate having a front end, opposed side edges, and a back end;

b. a cutter joined to and protruding from the bottom plate proximate the front end thereof and having a tip;

c. a top plate having a front end and a back end pivotally joined to the bottom plate back end;

d. biasing means for maintaining the package opening tool in an open configuration whereat the top and bottom plates make an acute angle with respect to each other to define a generally V-shaped gap therebetween with the cutter being located within the gap, the top and bottom plates being pivotable relative to each other to a closed configuration whereat the top and bottom plates lie generally parallel to each other; and e. stop means formed on a selected one of the top and bottom plates for controlling the relative locations of the top and bottom plates when the package opening tool is in the closed configuration, wherein the stop means comprises a pair of spaced apart ridges fabricated on the top plate, the ridges straddling the cutter when the tool is in the closed configuration, and wherein the bottom plate is formed with walls upstanding therefrom and extruding along at least a portion of the side edges thereof, the walls having free ends that extend to a greater distance from the bottom plate than the cutter tip, so that the margin of a flexible package or the like can be inserted into the gap between the top and bottom plates when the package opening tool is in the open configuration and the plates can be pivoted to the closed configuration to penetrate the package with the cutter and thereby open the package and the V-shaped gap is defined by the ridges on the top plate and the walls of the bottom plate.

17. A tool for cutting a thin sheet of material comprising:

a. a bottom plate having a front end and a back end and opposed side edges and being formed with a cutter located near the front end thereof that protrudes a predetermined distance from the bottom plate and terminates in a tip, wherein the bottom plate cutter is formed as a thin blade lying in a plane that extends between the bottom plate front and back ends;

b. a top plate having a predetermined thickness and a back end pivotally connected to the top plate back end and a front end; and c. biasing means for pivoting the top and bottom plates about the pivotal connection therebetween to an open configuration whereat the top and bottom plates form a generally V-shaped gap with the cutter facing the top plate, the top and bottom plates being relatively pivotable against the biasing means to lie generally in a parallel relation to place the tool in a closed configuration, so that the thin sheet of material can be placed in the gap when the tool is in the open configuration and the plates can be squeezed to the closed configuration and thereby penetrate the thin sheet of material with the cutter and subsequent pulling of the sheet of material from between the top and bottom plates slices the material with the cutter.

18. The tool of claim 17 wherein:

a. the recess extends through the predetermined thickness of the top plate; and b. the top and bottom plates are generally in facing contact and the cutter lies entirely within the top plate recess when the tool is in the closed configuration.

19. The tool of claim 17 further comprising loop means joined to the back end of a selected one of the top and bottom plates for cooperating with the selected plate to hang the tool on a thin planar object.

20. A tool for cutting a thin sheet of material comprising:

a. a bottom plate having a front end and a back end and opposed side edges and being formed with a cutter located near the front end thereof that protrudes a predetermined distance from the bottom plate and terminates in a tip;

b. a top plate having a predetermined thickness and a back end pivotally connected to the top plate back end and a front end, wherein the bottom plate is formed with a wall around the front end and opposed side edges thereof, the wall having a free end that lies in a plane located between the tip of the cutter and the top plate; and c. biasing means for pivoting the top and bottom plates about the pivotal connection therebetween to an open configuration whereat the top and bottom plates form a generally V-shaped gap with the cutter facing the top plate, the top and bottom plates being relatively pivotable against the biasing means to lie generally in a parallel relation to place the tool in a closed configuration, so that the thin sheet of material can be placed in the gap when the tool is in the open configuration and the plates can be squeezed to the closed configuration and thereby penetrates the thin sheet of material with the cutter and subsequent pulling of the sheet of materials from between the top and bottom plates slices the material with the cutter and the gap is defined by the free end of the bottom plate wall and the top plate when the tool is in the open configuration and the cutter tip does not protrude into the gap.

21. The tool of claim 20 wherein the wall is formed with at least one guide surface located approximately midway between the bottom plate front and back ends to limit the insertion of the thin sheet of material into the gap between the bottom plate wall and the top plate.

22. The tool of claim 20 wherein the top plate nests inside the bottom plate wall when the tool is in the closed configuration.

23. A tool for cutting a thin sheet of material comprising:

a. a bottom plate having a front end and a back end and opposed side edges and being formed with a cutter located near the front end thereof that protrudes a predetermined distance from the bottom plate and terminates in a tip;

b. a top plate having a predetermined thickness and a back end pivotally connected to the top plate back end and a front end; and c. biasing means for pivoting the top and bottom plates about the pivotal connection therebetween to an open configuration whereat the top and bottom plates form a generally V-shaped gap with the cutter facing the top plate, the top and bottom plates being relatively pivotable against the biasing means to lie generally in a parallel relation to place the tool in a closed configuration, wherein the top plate defines a recess that is aligned with the cutter in the bottom plate, the recess having a depth sufficient to receive the cutter such that the cutter tip does not contact the top plate when the tool is in the closed configuration, and wherein the bottom plate is fabricated with an upstanding wall that extends around the front end and along at least a portion of the side edges thereof, and wherein the top plate is in facing contact with the bottom plate and nests within the bottom plate wall when the tool is in the closed configuration, so that the thin sheet of material can be placed in the gap when the tool is in the closed configuration and the plate can be squeezed to the closed configuration and thereby penetrate the thin sheet of material with the cutter and subsequent pulling of the sheet of material from between the top and bottom plates slices the material with the cutter.

24. The tool of claim 17 further comprising catch means integral with a selected one of the top and bottom plates for controlling the gap therebetween against the biasing means when the tool is in the open configuration.

25. The tool of claim 20 further comprising snap means formed on the bottom plate wall and overlying the top plate for controlling the gap between the top and bottom plates against the biasing means when the tool is in the open configuration.

26. The tool of claim 25 wherein the snap means comprises at least one guide surface located approximately midway between the bottom plate front and back ends for limiting the insertion of the sheet of thin material into the gap between the top and bottom plates.

27. A tool for cutting a thin sheet of material comprising:

a. a bottom plate having a front end and a back end and opposed side edges and being formed with a cutter located near the front end thereof that protrudes a predetermined distance from the bottom plate and terminates in a tip;

b. a top plate having a predetermined thickness and a back end pivotally connected to the top plate back end and a front end;

c. biasing means for pivoting the top and bottom plates about the pivotal connection therebetween to an open configuration whereat the top and bottom plates form a generally V-shaped gap with the cutter facing the top plate, the top and bottom plates being relatively pivotable against the biasing means to lie generally in a parallel relation to place the tool in a closed configuration; and d. stop means integral with a selected one of the top and bottom plates for controlling the locations of the top and bottom plates when the tool is in the closed configuration, wherein:

i. the bottom plate is fabricated with a wall upstanding from at least each of the side edges thereof, the top plate nesting within the bottom plate walls when the tool is in the closed configuration;

ii. the bottom plate cutter is formed as a thin blade that lies in a plane that extends between the bottom plate front and back ends; and iii. the stop means comprises at least one ridge formed in the top plate and extending from the front end thereof parallel to the cutter, the ridge cooperating with the bottom plate wall to define the gap when the tool is in the open configuration, the ridge contacting the bottom plate to control the top and bottom plates when the tool is in the closed configuration, and the cutter lying adjacent the ridge when the tool is in the closed configuration, so that the thin sheet of material can be placed in the gap when the tool is in the closed configuration and the plates can be squeezed to the closed configuration and thereby penetrate the thin sheet of material with the cutter and subsequent pulling of the sheet of material from between the top and bottom plates slices the material with the cutter.

28. The tool of claim 17 wherein the biasing means comprises a spring having first and second ends that are captured in the top and bottom plates, respectively.

29. The tool of claim 17 wherein the bottom plate has a cross section that is concave with respect to the top plate, and wherein the side edges of the bottom plate lie in a plane located between the cutter tip and the top plate.

30. A tool for cutting a thin sheet of material comprising:

a. a bottom plate having a front end and a back end and opposed side edges and being formed with a cutter located near the front end thereof that protrudes a predetermined distance from the bottom plate and terminates in a tip;

b. a top plate having a predetermined thickness and a back end pivotally connected to the top plate back end and a front end; and c. biasing means for pivoting the top and bottom plates about the pivotal connection therebetween to an open configuration whereat the top and bottom plates form a generally V-shaped gap with the cutter facing the top plate, the top and bottom plates being relatively pivotable against the biasing means to lie generally in a parallel relation to place the tool in a closed configuration, wherein:

i. the bottom plate is formed with walls along the opposed side edges thereof, the walls having respective free ends that lie in a plane located between the tip of the cutter and the top plate; and ii. the top plate is formed with a pair of spaced ridges that straddle the cutter when the tool is in the closed configuration, the ridges having respective free ends that serve as stops that limit the approach of the top and bottom plates toward each other and thereby define the closed configuration, the free ends of the ridges cooperating with the free ends of the bottom plate walls to define the gap when the tool is in the open configuration, so that the thin sheet of material can be placed in the gap when the tool is in the closed configuration and the plates can be squeezed to the closed configuration and thereby penetrate the thin sheet of material with the cutter and subsequent pulling of the sheet of material from between the top and bottom plates slices the material with the cutter and the space between the ridges forms a recess for receiving the cutter when the tool is in the closed configuration.

31. A method of opening a package of thin flexible material comprising the steps of:

a. providing first and second plates having respective front ends and back ends that are pivotally connected to each other and defining a V-shaped gap therebetween, the first plate being formed with a cutter near the first end thereof that extends into the gap;

b. inserting a margin of the package into the gap between the plates;

c. pivoting the plates relative to each other to a closed configuration whereat the V-shaped gap is dissipated and the plates are generally parallel to thereby penetrate the package with the cutter; and d. pulling the package from between the plates to thereby slit the package with the cutter, wherein:

i. the step of providing a first plate with a cutter comprises the step of providing a first plate with a cutter that lies in a plane that extends between the front and back ends of the first plate; and ii. the step of pulling the package comprises the step of pulling the package in a direction parallel to the plane extending between the first plate front and back ends.

32. The method of claim 31 wherein the step of providing first and second plates comprises the further step of providing a guide surface on a selected one of the plates for limiting the insertion of the package margin into the V-shaped gap.

33. A method of opening a package of thin flexible material providing first and second plates having respective front ends and back ends that are pivotally connected to each other and defining a V-shaped gap therebetween, the first plate being formed with a cutter near the first end thereof that extends into the gap, wherein the step of providing a second plate comprises the step of forming a recess in the second plate sized to receive the entire cutter that extends into the gap;

b. inserting a margin of the package into the gap between the plates;

c. pivoting the plates relative to each other to a closed configuration whereat the V-shaped gap is dissipated and the plates are generally parallel to thereby penetrate the package with the cutter; and d. pulling the package from between the plates to thereby slit the package with the cutter, so that the cutter does not contact the first plate when the first and second plates are pivoted to the closed configuration.

* * * * *